US005434765A

United States Patent [19]

Kelly et al.

[11] Patent Number: 5,434,765

[45] Date of Patent: Jul. 18, 1995

[54] LUMINAIRE ASSEMBLY

[75] Inventors: Rick M. Kelly; Herbert A. Fouke, both of Newark, Ohio

[73] Assignee: Holophane Corporation, Newark, Ohio

[21] Appl. No.: 209,535

[22] Filed: Mar. 10, 1994

[51] Int. Cl.[6] ..... F21V 29/00; F21V 5/00

[52] U.S. Cl. ..... 362/274; 362/337; 362/308; 362/328; 362/329; 362/345; 362/334

[58] Field of Search ..... 362/337, 294, 265, 334, 362/307, 308, 309, 310, 329, 327, 334, 345, 328, 373

[56] References Cited

U.S. PATENT DOCUMENTS

| | | | |
|---|---|---|---|
| 1,233,617 | 7/1917 | Sweet | 362/294 X |
| 1,357,559 | 11/1920 | Heilenday | 362/363 |
| 1,873,291 | 8/1932 | Cole | 362/294 |
| 1,900,330 | 3/1933 | Chartrand | 362/363 X |
| 1,916,169 | 6/1933 | Exelmans | 362/299 |
| 2,756,326 | 7/1956 | Franck | 362/309 |
| 2,814,723 | 11/1957 | Franck et al. | 362/334 |
| 3,329,812 | 7/1967 | Harling | 362/309 X |
| 3,521,701 | 7/1970 | Mori . | |
| 3,705,302 | 12/1972 | Judge et al. | 362/265 X |
| 3,705,303 | 12/1972 | Willis, Jr. et al. | 362/327 X |
| 4,237,528 | 12/1980 | Baldwin | 362/263 |
| 4,704,665 | 11/1987 | Grindle | 362/375 X |
| 4,796,169 | 1/1989 | Shemitz | 362/282 |
| 4,839,281 | 6/1989 | Barnes et al. | 362/337 X |
| 4,858,091 | 8/1989 | Fouke | 362/332 |
| 5,016,146 | 5/1991 | Kaspar | 362/223 X |
| 5,121,309 | 6/1992 | Ewing et al. | 362/226 |
| 5,134,554 | 7/1992 | Donato et al. | 362/226 |
| 5,138,541 | 8/1992 | Kano | 362/345 |
| 5,174,646 | 12/1992 | Siminovitch et al. | 362/294 |
| 5,251,118 | 10/1993 | Budnovitch et al. | 362/362 |

*Primary Examiner*—Ira S. Lazarus
*Assistant Examiner*—Thomas M. Sember
*Attorney, Agent, or Firm*—Brooks & Kushman

[57] ABSTRACT

A luminaire assembly which is adapted for easy cleanability. The luminaire assembly includes a housing portion having a substantially smooth outer surface and which is further adapted to receive and enclose a ballast assembly. An optical assembly is further adapted to be affixed to the housing portion in a substantially sealed, water-tight relationship to define an internal chamber to receive and enclose a lamp. The optical assembly has an inner surface and an outer surface contiguous with the housing portion outer surface and has an opening defined therein. A removable door has an inner surface and an outer surface adapted to be affixed in a sealed relationship with the optical assembly opening when in a closed position. The door is further provided with a breathing aperture of a predetermined lateral dimension for permitting ambient air to enter and leave the internal chamber. The outer surfaces of the optical assembly and removable door have the characteristic of shutting water and accumulated contaminants without leaving residue thereon so as to provide easy cleanability. The optical assembly further incorporates specially designed inner and external optics necessary to compensate for the reduced uplight which is dictated by the three-dimensional design of the optical assembly.

9 Claims, 6 Drawing Sheets

Fig. 8
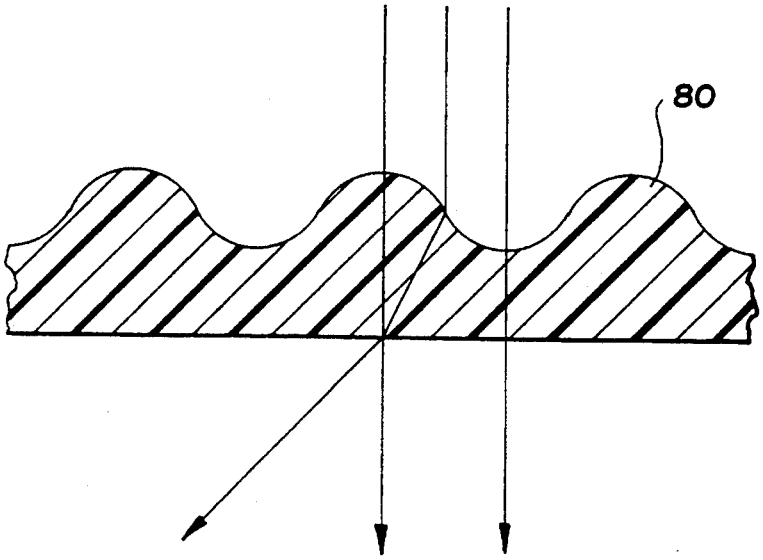
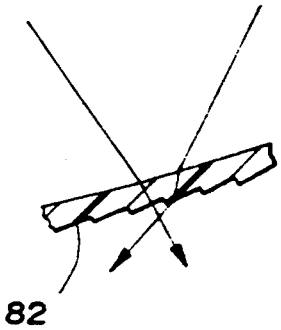
Fig. 9a
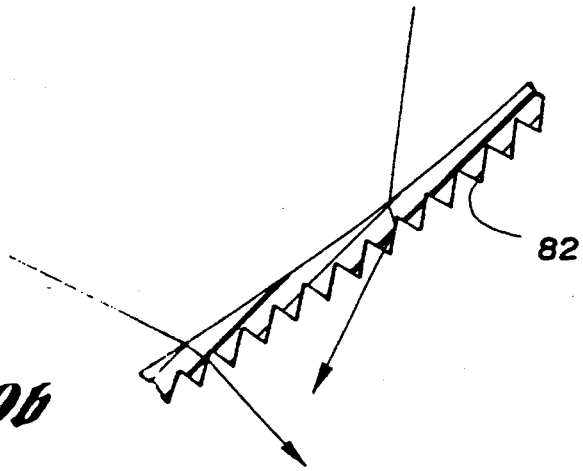
Fig. 9b

LUMINAIRE ASSEMBLY

TECHNICAL FIELD

This invention relates to an improved industrial luminaire directed for use in high contaminant areas which is adapted for easy cleanability.

BACKGROUND ART

Prior art industrial luminaires of the type depicted in FIG. 1 and designated by reference numeral 10, for example, have proven unsatisfactory for use in commercial food processing and related operations which require regular cleansing or sterilization of the factory premises, including its machinery and lighting units. These prior art industrial luminaire designs have typically incorporated ballast housings 12 and optical units or lenses 14 which have numerous external components having horizontal or near horizontal surfaces 16. Because of their exposure to the surrounding atmosphere, these component surfaces are particularly susceptible to the accumulation of contaminants such as food stuffs and the like. As appreciated by those skilled in the art, such accumulation may enhance the growth of bacteria and other microscopic organisms, none of which are desirable from an operations standpoint.

In an effort to overcome the above-identified limitations of the prior art, Applicants sought to design and develop an improved luminaire assembly having reduced external components and horizontal surfaces. As a starting point for their design work, Applicants thus turned their attention toward the design of a luminaire assembly having an optical assembly with a three-dimensional shape which enhanced the shedding of food particles and promoted the desired objective of easy cleanability. Keeping in mind the desired application, i.e. food processing operations which require regular cleansing, the optical assembly was also required to be affixed in a sealed relationship with a ballast housing in a substantially water-tight relationship so as to enclose and protect an internal lamp. As appreciated by those skilled in the art, this latter sealing requirement led to the further requirement of a breathing mechanism so as to provide proper ventilation for the enclosed lamp. Such a mechanism is especially required when using High Intensity Discharge (HID) lamps as anticipated for use with the present invention and, which are known to produce extreme heat during operation.

Previous attempts have been made to incorporate ventilation and heat dissipation means within industrial luminaires. These prior art attempts, however, have failed to meet the objectives addressed by Applicants and resolved by the invention disclosed herein because these prior art devices have inherently introduced additional external components which are prone to accumulation of contaminants. Examples of these prior art luminaires which have incorporated one or more ventilation means are shown, for example, in U.S. Pat. Nos. 5,174,646, 5,134,554, 5,138,541, 3,521,701 and 4,704,665 issued to Siminovitch et al, Donato et al, Kano, Shinjiro Mori, and Grindle, respectively.

U.S. Pat. No. 5,174,646 issued to Siminovitch et al discloses a lighting fixture which includes a heat transfer structure which is independent of and disposed externally of the housing for transferring heat energy generated from a fluorescent lightbulb through the heat transfer structure to the outside of the housing.

Similarly, U.S. Pat. No. 5,134,554, issued to Donato, discloses a lighting system which incorporates a plurality of air-flow channels between the globe support housing and the lamp socket support body. As shown and disclosed, air-flow passageways are provided in communication with the air-flow channels. The air-flow passageways as well as the air-flow channels are further provided in communication with the ambient atmosphere. In operation, air flow patterns created by the air-flow passageways and channels of the luminaire assembly serve to carry heat away from the halogen lamp up along the air-flow channels and into the ambient atmosphere.

U.S. Pat. No. 5,138,541, issued to Kano, is similarly directed to a refrigerator light which incorporates openings to provide effective air circulation for the lamp. As disclosed by Kano, these openings are arranged in the edge region of the lamp near the cylindrical housing outer wall such that air may enter the interior of the housing at the outside of the cold-light reflector near the outer housing wall, flow over the housing wall and then emerge from the interior of the housing in the rear region of the lamp.

U.S. Pat. No. 3,521,701, issued to Shinjiro Mori, is directed to an industrial safety illuminating apparatus which incorporates air-passageways to serve as a radiator device. As disclosed, the air-passageways are in the form of radiator pipes which extend radially on the external peripheral wall face of the unit.

Finally, U.S. Pat. No. 4,704,665, issued to Grindle, discloses an electrical luminaire comprised of weather and corrosion resistant housing material. No ventilation or breathing mechanism, however, is taught or suggested for use in connection with the invention disclosed therein.

Keeping in mind the intended application the luminaire under design, i.e., food processing and related operations, Applicants were further required to develop a luminaire assembly which, in addition to the above limitations of three-dimensional shape and thermal breathability, provided sufficient uplight and downlight capability.

Consequently, applicants recognized and addressed the need for an improved luminaire assembly which is adapted for use in food processing operations and the like which require reduced external components and horizontal surfaces so as to promote easy cleanability. Applicants further recognized and addressed the need for such an industrial luminaire having sufficient uplight and downlight capability for use in commercial food processing operations and which further permits easy relamping through an external releasable door.

Still further, applicants recognized and addressed the need for an improved luminaire assembly having the above characteristics and which further incorporates a novel breathing mechanism for providing sufficient ventilation so as to optimize the thermal operating characteristics of the luminaire thus minimizing operating costs and maximize luminaire life.

DISCLOSURE OF THE INVENTION

It is, therefore, a principal object of the present invention to overcome the limitations of the prior art by providing a luminaire assembly which is adapted for easy cleanability in commercial food processing and related operations.

A more specific object of the present invention is the provision of a luminaire assembly adapted for easy cleanability and relamping and which further provides sufficient internal heat dissipation for effective use in commercial food processing and related operations.

Yet another more specific object of the present invention is the provision of a luminaire assembly directed for use in commercial food processing and related operations which is adapted for easy cleanability .through the provision of a specially designed and shaped optical unit, a breathing aperture provided in thermal communication with the ambient atmosphere and which provides sufficient uplight and downlight while at the same time inhibiting the accumulation of contaminants and the growth of bacteria and other undesirable microscopic organisms.

In carrying out the above disclosed objects and other objects, features and advantages of the present invention, there is provided a luminaire assembly adapted for easy cleanability which comprises a ballast assembly as well as a housing portion which is adapted to receive and enclose the ballast assembly. The housing portion has a substantially smooth outer surface. The luminaire assembly further comprises a lamp and an optical assembly which is adapted to be affixed to the housing portion in a sealed relationship so as to define an internal chamber to receive and enclose the lamp. The optical assembly has an outer surface which is contiguous with the housing portion outer surface and further has an opening defined therein. In keeping with the invention, the luminaire assembly further comprises a removable door which is adapted to be affixed in a sealed relationship with the optical assembly opening when in a closed position. To provide the required thermal breathability, a breathing aperture of a predetermined lateral dimension is also provided for permitting ambient air to enter and leave the internal chamber defined by the optical assembly. The outer surfaces of the housing portion, optical assembly and removable door have the characteristic of shedding water and accumulated contaminants therefrom without leaving a residue thereon, so as to provide the above-referenced easy cleanability.

The invention also provides a luminaire assembly adapted for easy cleanability as referenced above which further comprises a fastener having a head and shank of predetermined lateral dimensions less than the lateral dimension of the breathing aperture. Still further, the assembly comprises a substantially rigid strap disposed within the internal chamber defined by the optical assembly which also has an aperture defined therein which is adapted to receive the fastener shank. There is further provided a plurality of tabs which are disposed sufficiently within the breathing aperture to define a passage adapted to receive the fastener shank and lock the removable door in place when in the closed position.

To achieve the desired uplight and downlight capability which is limited, in the first instance, by the three-dimensional shape of the luminaire assembly, the optical assembly is equipped with a bottom refractor, an upper reflector-refractor, and an internal metal reflector. As disclosed herein, the bottom refractor is adapted to receive direct and reflected light and includes radial laterally diffusing flutes disposed on its inside surface and horizontal circular refracting prisms disposed on its outside surface for refracting direct light below the glare zone and inhibiting reflected light from entering the glare zone. Similarly, the upper reflector-refractor has an upper substantially vertical portion which is disposed within the general planes of the housing portion periphery and a lower portion which is uniformly deformed out of a general planes of the housing portion periphery and affixed to the bottom reflector-refractor. The upper portion includes vertical laterally diffusing flutes disposed on the optical assembly inner surface and horizontal vertically diffusing flutes disposed on the optical assembly outer surface for providing a smoothed out uplight component. The lower portion includes horizontal prisms disposed on the optical assembly inside surface and ninety degree reflecting prisms disposed on the optical assembly outside surface for providing light rays at the bottom refractor at a low vertical angle.

Still further, the internal metal reflector, which is affixed to the upper reflector-refractor upper portion is provided to reflect light rays down to the bottom refractor at a low vertical angle. The removable door, which, as referenced above, is adapted to permit easy relamping, is further adapted to receive direct and reflected light, like the bottom refractor. The removable door thus further includes radial laterally diffusing flutes disposed on its inside surface and horizontal circular refracting prisms on its outside surface for refracting direct light below the glare zone and inhibiting reflected light from entering the glare zone.

These and other objects, features and advantages of the present invention, as well as its various benefits, will be made more clear in the best modes for carrying out the invention which follows and the accompanying drawings in which like reference numerals correspond to like components.

BRIEF DESCRIPTION OF THE DRAWINGS

FIG. 8 is a schematic diagram of the radial laterally diffusing flutes disposed on the inside surface of the bottom refractor portion of the optical unit of the present invention;

Figure 10:
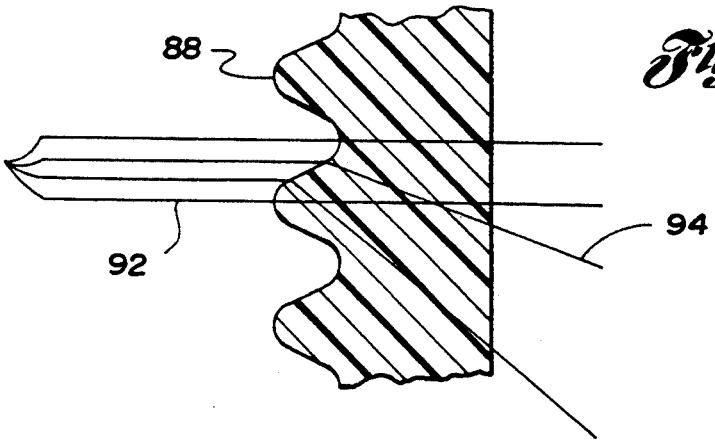
Figure 11:
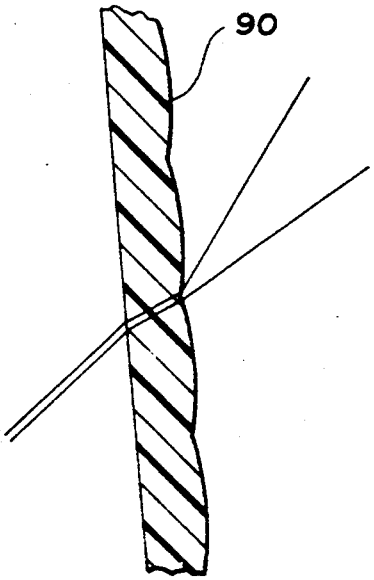
Figure 12:
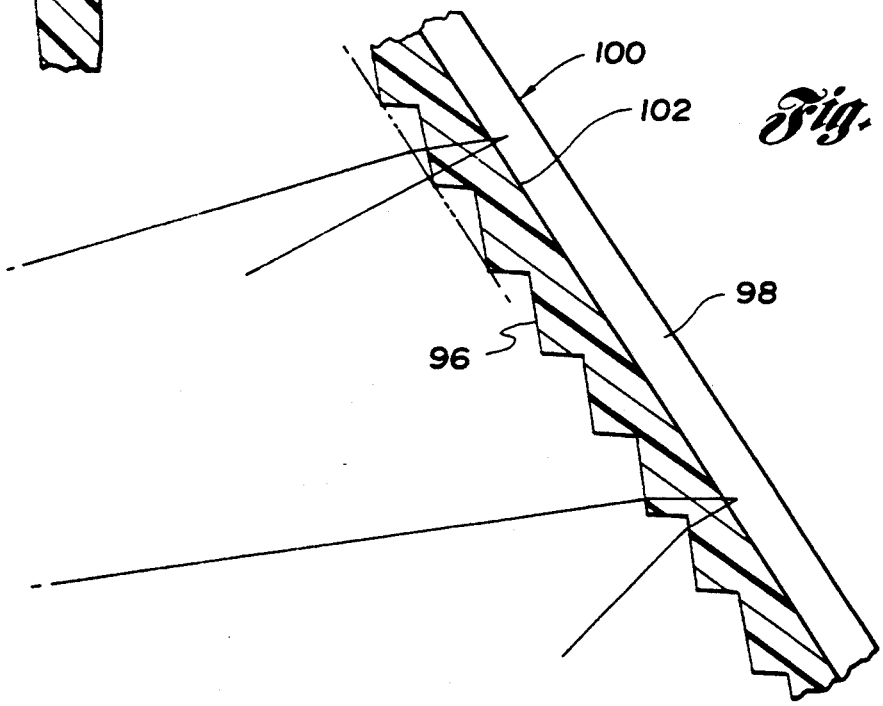

FIGS. *9a–9b* are schematic diagrams of the horizontal circular refracting prisms disposed on the outside surface of the bottom refractor portion of the optical unit of the present invention;

FIG. 10 is a schematic diagram of the vertical laterally diffusing flutes disposed on the inner surfaces of the upper reflector-refractor portion of the optical unit of the present invention;

FIG. 11 is a schematic diagram of the horizontal vertically diffusing flutes disposed on the outer surface of the upper reflector-refractor portion of the optical unit of the present invention; and FIG. 12 is a schematic diagram illustrating the horizontal prisms and 90° reflecting prisms disposed on the inside and outside surfaces of the upper reflector-refractor portion of the optical unit of the present invention.

BEST MODES FOR CARRYING OUT THE INVENTION

Figure 1:
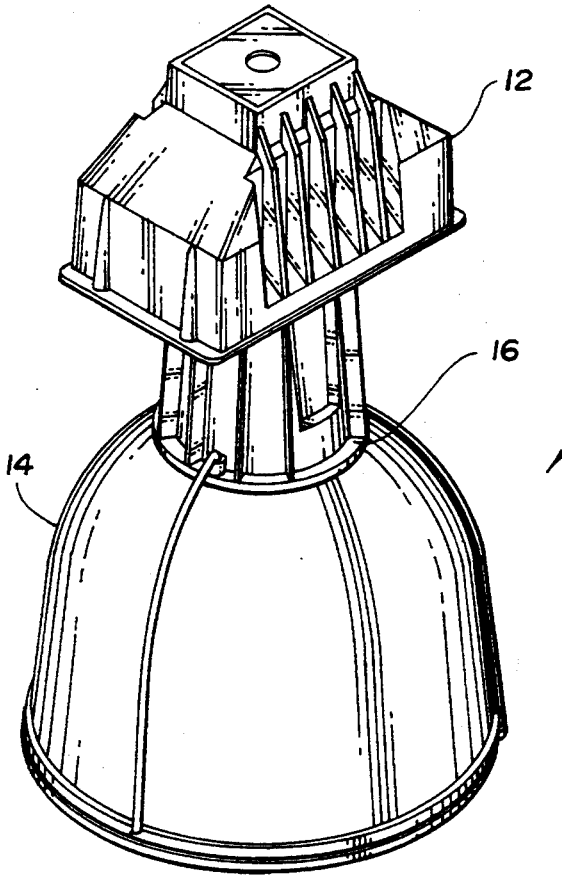
Fig. 1 (PRIOR ART)
FIG. 1 is a perspective view of a prior art luminaire assembly.
Figure 2:
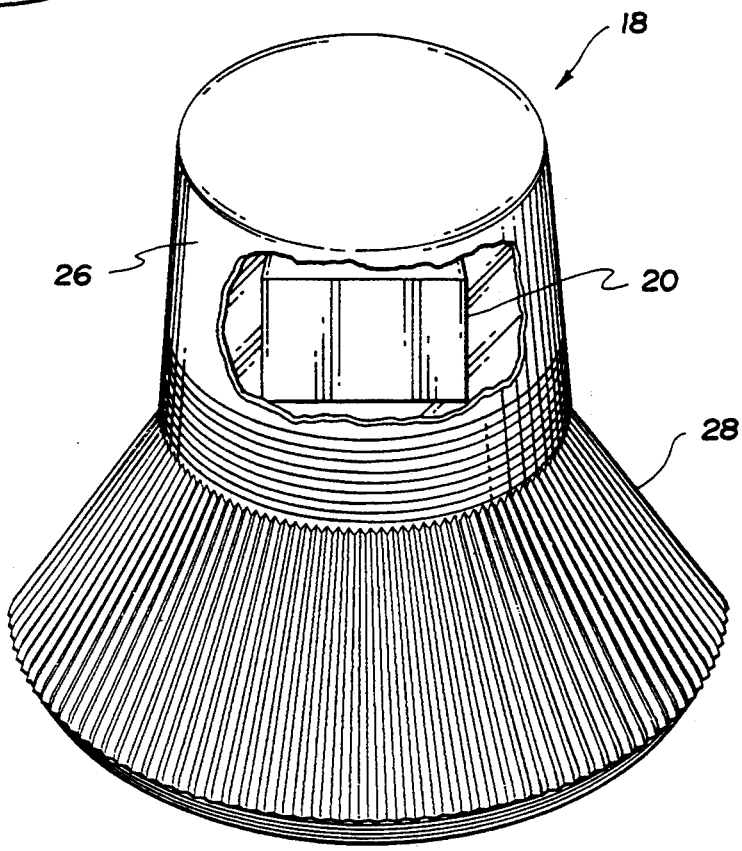
FIG. 2 is a perspective view of the luminaire assembly of the present invention shown partially fragmented to illustrate the internal components thereof.
Figure 3:
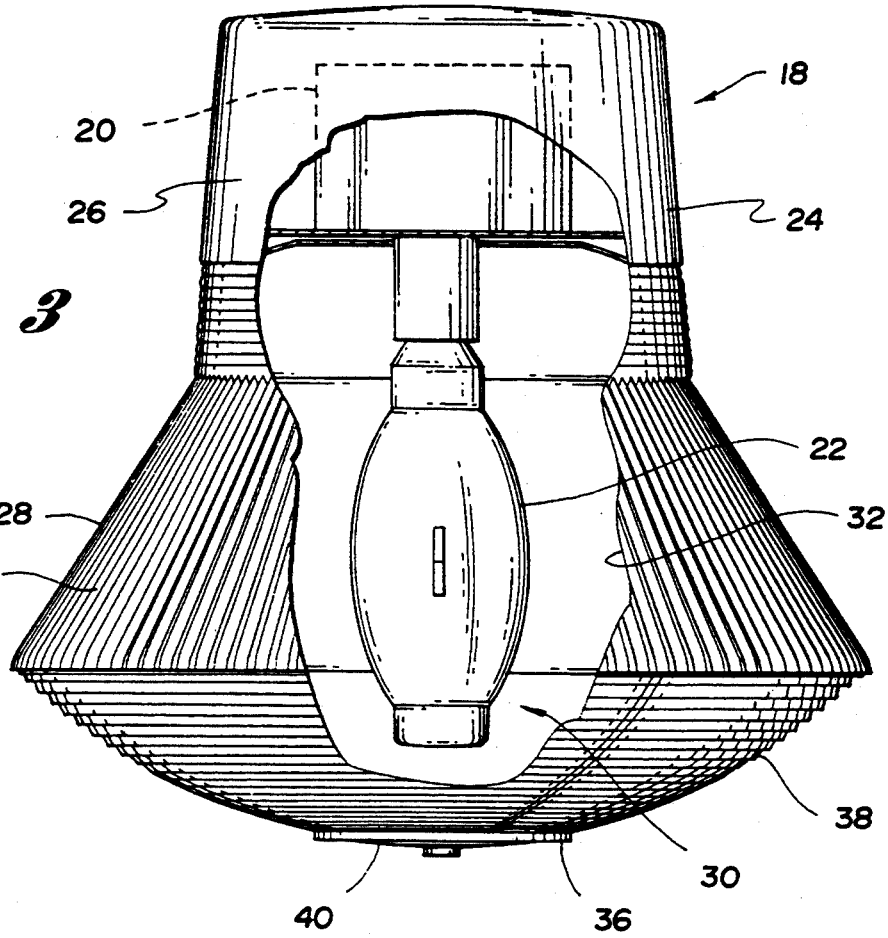
FIG. 3 is a side elevational view of the luminaire assembly of the present invention also shown partially fragmented to illustrate the internal components.

Referring to FIGS. 2–3 of the drawings, perspective and side elevational views of the luminaire assembly 18 of the present invention are provided. FIGS. 2 and 3 are both partially broken away to better illustrate the internal components such as ballast 20 and lamp 22 which are enclosed and protected by the luminaire assembly 18.

As shown in FIGS. 2–3, luminaire assembly 18 includes a housing portion 24 which is adapted to receive, enclose and protect ballast assembly 20. Housing portion 24 has a substantially smooth outer surface 26 which may be comprised of anodized aluminum or other suitable heat resistant material. Luminaire assembly 18 further comprises an optical assembly 28 which is adapted to be affixed to housing portion 24 so as to define an internal chamber 30 to receive and enclose lamp 22. Significantly, optical assembly 28 is adapted to be affixed to housing portion 24 in a sealed and substantially water-tight relationship so as to prevent water and other contaminants from entering internal chamber 30 during manufacturing or processing operations as well as during routine washing.

In keeping with the invention, optical assembly 28 is further provided with an inner surface 32 and an outer surface 34 which is adapted to be contiguous with housing portion 24 so as to inhibit the accumulation of contaminants and the corresponding growth of bacteria and other undesirable microscopic organisms. Optical assembly 28 further incorporates an opening 36 which, in a preferred embodiment, is disposed on the bottom refractor section 38 of optical assembly 28. It is recognized, however, that depending upon the desired use and operation of the luminaire assembly, opening 36 may be disposed at any suitable location about the periphery of optical assembly 28 including upper reflector-refractor section 39.

In further keeping with the invention, optical assembly opening 36 is of a predetermined lateral dimension and, in the preferred embodiment, is provided as a substantially circular opening having a diameter on the order of 5–7 inches. A removable relamping door 40 is further provided which is adapted to be affixed in a sealed and substantially water-tight relationship with optical assembly opening 36 when door 40 is in a closed position as shown in FIG. 5.

Figure 4:
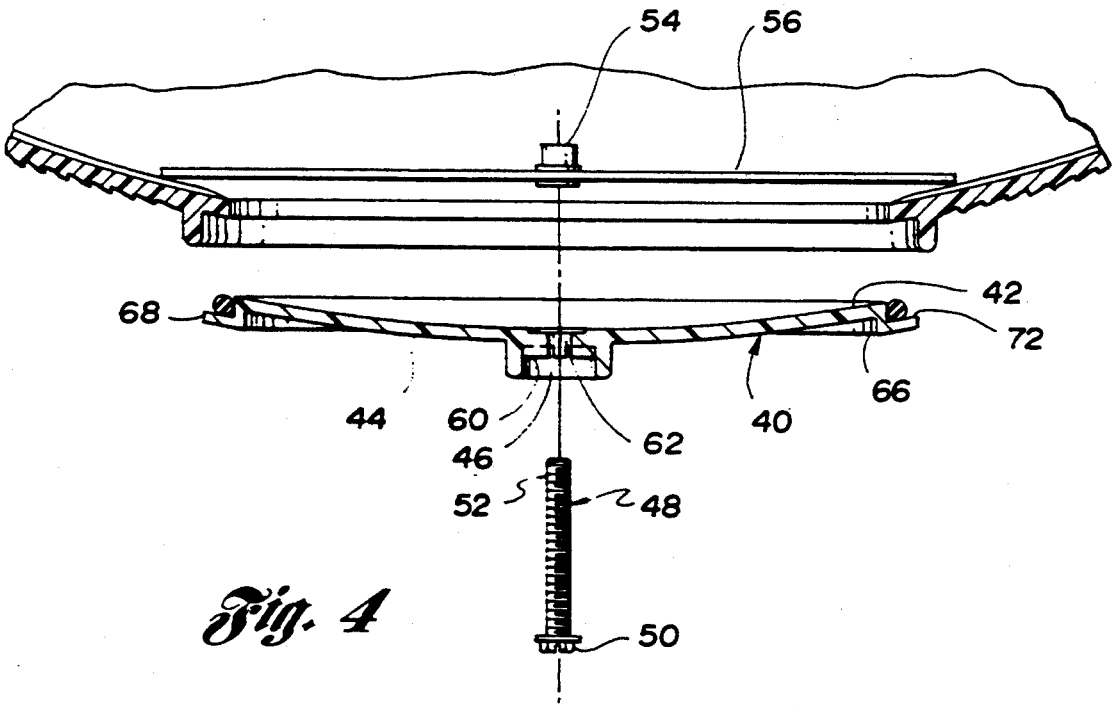
FIG. 4 is an exploded cross-sectional view of the removable relamping door of the luminaire assembly of the present invention shown in FIGS. 2 and 3.
Figure 5:
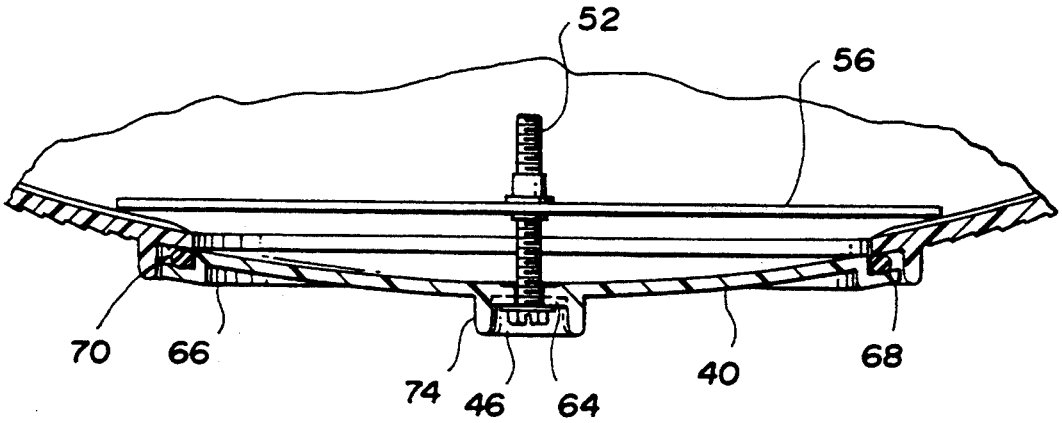
FIG. 5 is a cross-sectional view of the removable relamping door of the luminaire assembly of the present invention shown in a closed position.
Figure 6:
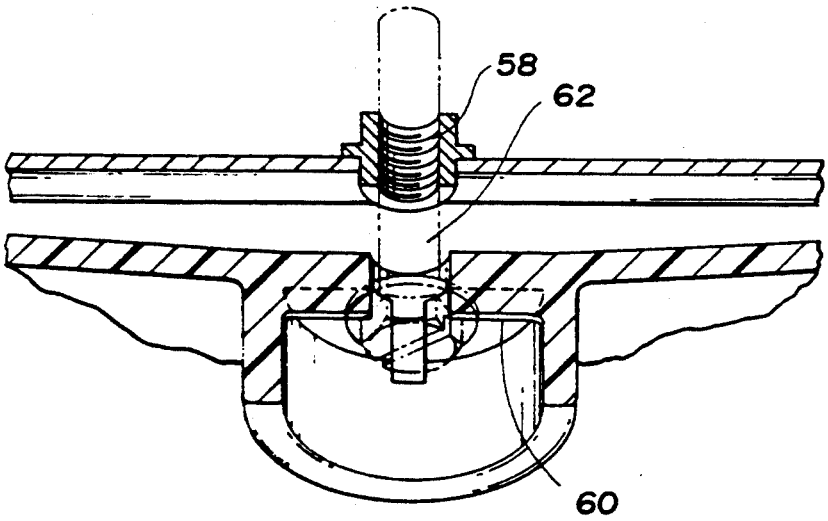
FIG. 6 is an exploded cross-sectional view of the removable relamping door of the present invention showing in further detail the breathing aperture incorporated therein.

With reference now to FIGS. 4–6 of the drawings, the removable relamping door incorporated in the luminaire assembly of the present invention may be further described. As shown, door 40, like optical assembly 28 and housing portion 24 also comprises an inner surface 42 and an outer surface 44. Door 40 and optical assembly 28 may similarly be comprised of high temperature acrylic or other suitable temperature resistant material. Door 40 further incorporates a breathing aperture 46 of a predetermined lateral dimension which is on the order of 0.204 inches in the preferred embodiment for permitting ambient air to enter and leave internal chamber 30. As shown, there is further provided a fastener 48 having a head 50 and a shank 52, shank having predetermined lateral dimensions less than the lateral dimensions of breathing aperture 46. Again, in the preferred embodiment, fastener shank 52 has lateral dimension on the order of 0.190 inches. Shank 52 of fastener 48 is adapted to be received in an aperture 54 defined in a substantially rigid strap 56 disposed within internal chamber 30. Fastener 52 may comprise, for example, a simple screw or bolt adapted to be received by aperture 54 having corresponding threads 58 defined therein.

As shown more particularly, in FIG. 6, a plurality of tabs 60 may further be disposed sufficiently within breathing aperture 46 so as to define a passage 62 which is adapted to receive shank 52 of fastener 48 yet, at the same time, prevent head 50 from passing therethrough. In such manner, ambient air may be permitted to pass in and out of breathing aperture 46 within the area 64 which is neither covered by the lateral dimension of fastener head 50 nor tabs 60.

As further seen in the preferred embodiment, tabs 60 are disposed within aperture 46 in the form of radial fins having a width on the order of 0.060" and a height on the order 0.030".

Still referring to FIGS. 4–6 of the drawings, optical assembly 28 further incorporates a first barrier 66 which is adapted to receive gasket 68 disposed radially within a raceway 70 defined by barrier 66 and relamping door lip 72. There is further provided a second barrier 74 disposed about the periphery of breathing aperture 46 to prevent water or contaminants being shed from entering the breathing aperture 46.

The Optics

Figure 7:
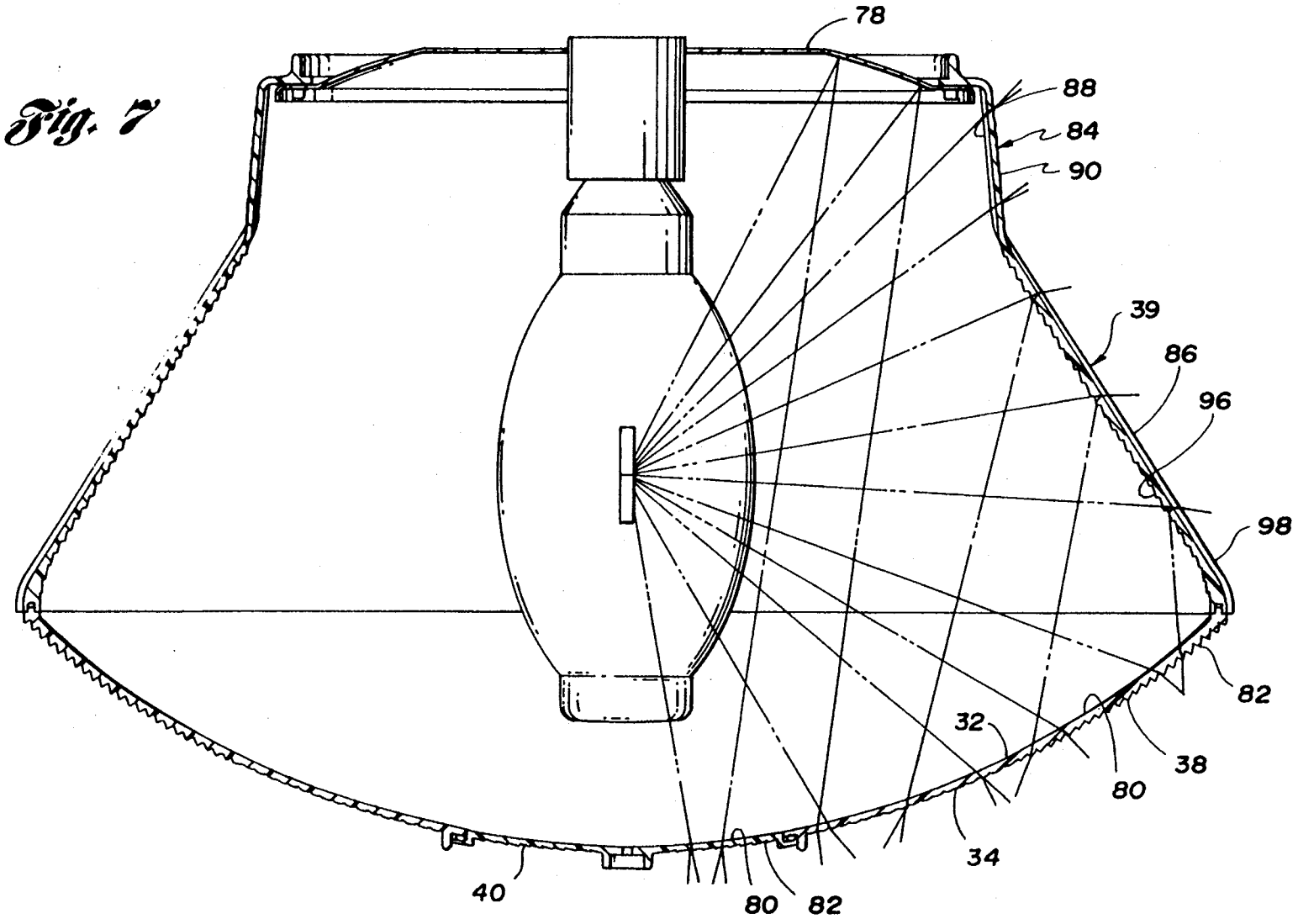
FIG. 7 is a cross-sectional view of the optical unit of the present invention.

Referring now to FIG. 7 of the drawings, it is further seen that in the preferred embodiment optical assembly 28 further comprises a bottom refractor portion 38. As referenced above, optical assembly 28 further includes an upper reflector-refractor section 39 and an internal metal reflector 78 affixed there for reflecting light rays down to the bottom refractor section 38 at a low vertical angle. Finally, optical assembly 28 includes a removable door 40.

As shown in further detail in FIGS. 8–9, bottom refractor portion 38, which is adapted to receive direct and reflected light, includes radial laterally diffusing flutes 80 disposed on the inside surface 32 of optical assembly 28 and horizontal circular refracting prisms 82 disposed on the outside surface 34 of the same for refracting the direct light below the glare zone and inhibiting the reflected light from entering the glare zone. As also shown in FIG. 7, upper reflector-refractor section 39 includes an upper substantially vertical portion 84 which is disposed within the general planes of the periphery of the housing portion 24, as well as a lower portion 86, which is uniformly deformed out of the general planes of the periphery of housing portion 24. As seen, lower portion 86 is affixed to the bottom refractor portion 38.

Referring still generally to FIG. 7 and specifically to FIGS. 10–11, upper vertical portion 84 is shown including vertical laterally diffusing flutes 88 disposed on the inner surface 32 of optical assembly 28 and horizontal vertically diffusing flutes 90 disposed on the outer surface 34 of optical assembly 28 for providing a smoothed out uplight component. Vertical laterally diffusing flutes 88 are provided with curved surfaces such that light rays 92 are diverted laterally at varying angles to be emitted as light rays 94. These light rays are spread laterally through a range of about ±62°, as explained in further detail in U.S. Pat. No. 4,858,991 to Fouke, which is assigned to the assignee of the present invention and which is incorporated herein by reference.

As further seen with reference to FIG. 12, lower portion 86 of upper reflector-refractor section 39 further includes horizontal prisms 96 disposed on the inside surface 32 of optical assembly 28, as well 90 degree reflecting prisms 98 disposed on the outside surface 34 of optical assembly 28 for providing light rays at the bottom refractor 38 at a low vertical angle.

In keeping with the invention, the removable door 40 is further adapted to receive direct and reflected light and, like the bottom refractor portion 38, includes radial laterally diffusing flutes 80 disposed on the inside surface 32 of optical assembly 28 and horizontal circular refracting prisms 82 disposed on the outside surface 34 of optical assembly 28 for refracting direct light below the glare zone and inhibiting reflected light from entering the glare zone.

In keeping with the invention and as shown in FIGS. 7–12, in operation, light rays striking the internal metal reflector 78 are reflected down to strike the bottom refractor section 38 at a low vertical angle as referenced above. Similarly, rays striking the top vertical portion 84 of the upper reflector-refractor section 39 are transmitted at an angle above horizontal so as to provide a significant uplight component. As referenced above, the inside surface 32 of this section has vertical laterally diffusing flutes 88 and the outside surface 34 has horizontal vertically diffusing flutes 90, both active to help smooth out the distribution on the ceiling.

In further keeping with the invention, the upper reflector-refractor section 39 is further designed with the above optics such that rays striking it are first refracted by the horizontal prisms 96, then reflected by the 90 degree reflecting prisms 98 and again refracted by the inside prisms 96 as shown in FIG. 12. This combination of refraction-reflection results in the final reflected rays striking the bottom lens at a lower vertical angle than if there were no inside prisms on the upper reflector. As recognized by those skilled in the art, this unique optical construction aids in obtaining the proper width distribution required for this application, i.e. food processing, as dictated by the three-dimensional design of optical unit 28.

Significantly, a small percentage of the light striking the reflecting prisms 98 is not reflected but, rather, is transmitted through the slightly rounded peaks and valleys 100 and 102 of prisms 96. This leakage light adds useful light above and below 90 degrees.

From the foregoing, it can be seen that there has been provided by the subject invention a new and novel luminaire assembly which is directed for use in food processing and related operations which is adapted for easy cleanability, yet provides sufficient thermal operational characteristics as well as sufficient uplight and downlight. It should be obvious that although preferred embodiments of the invention have been described herein, it is possible to make changes to certain specific details of the luminaire assembly without departing from the spirit and scope of the invention.

What is claimed is:

1. For use in a luminaire assembly having a housing portion and a lamp, an improved optical assembly adapted for easy cleanability, comprising:

an optical assembly having an inner surface and an outer surface and adapted to be affixed to said housing in a sealed relationship, said optical assembly defining an internal chamber to receive and enclose said lamp and having an opening defined therein;

a removable door adapted to be affixed in a sealed relationship with said optical assembly opening when in a closed position, said door further having a breathing aperture of a predetermined lateral dimension for permitting ambient air to enter and leave said internal chamber;

a fastener having a head and shank of predetermined lateral dimensions less than said breathing aperture lateral dimension;

a substantially rigid strap disposed within said internal chamber, said strap having an aperture defined therein and adapted to receive said fastener shank;

a plurality of tabs disposed sufficiently within said breathing aperture to define a passage adapted to receive said fastener shank; and a barrier disposed about the periphery of said breathing aperture to prevent water or contaminants being shed from entering said breathing aperture.

2. A luminaire assembly adapted for easy cleanability, comprising:

a ballast assembly;

a housing portion adapted to receive and enclose said ballast assembly, said housing portion having a substantially smooth outer surface;

a lamp;

an optical assembly adapted to be affixed to said housing portion in a sealed relationship, said optical assembly defining an internal chamber to receive and enclose said lamp, said optical assembly having an inner surface and an outer surface contiguous with said housing portion outer surface and having an opening defined therein;

a removable door having an inner surface and an outer surface adapted to be affixed in a sealed relationship with said optical assembly opening when in a closed position, said door further having a breathing aperture of a predetermined lateral dimension for permitting ambient air to enter and leave said internal chamber, said housing portion outer surface, optical assembly outer surface and removable door outer surface together having the characteristic of shedding water and accumulated contaminants therefrom without leaving residue thereon;

a fastener having a head and shank of predetermined lateral dimensions less than said breathing aperture lateral dimension;

a substantially rigid strap disposed within said internal chamber, said strap having an aperture defined therein and adapted to receive said fastener shank; and a plurality of tabs disposed sufficiently within said breathing aperture to define a passage adapted to receive said fastener shank.

3. A luminaire assembly as in claim 2, wherein said breathing aperture includes an annular barrier to prevent water or contaminants being shed from entering said breathing aperture.

4. A luminaire assembly as in claim 2, wherein said optical assembly is comprised of high temperature acrylic.

5. A luminaire assembly as in claim 2, wherein said housing portion is comprised of iodized aluminum, painted aluminum, or other suitable finish.

6. A luminaire assembly as in claim 2, wherein said removable door is comprised of high temperature acrylic.

7. A luminaire assembly as in claim 2, wherein said optical assembly comprises:

a bottom refractor section having an inner surface with radial laterally diffusing flutes disposed thereon, and an outer surface with horizontal circular refracting prisms disposed thereon;

an upper reflector-refractor section having an upper substantially vertical portion affixable to said housing portion and a lower portion affixable to said bottom refractor section, said upper portion of said upper reflector-refractor section having an inner surface with vertical laterally diffusing flutes disposed thereon, and an outer surface with horizontal vertically diffusing flutes disposed thereon, said lower portion of said upper reflector-refractor section having an inner surface with horizontal prisms disposed thereon, and an outer surface with 90° reflecting prisms disposed thereon; and an internal metal reflector affixable to said upper portion of said upper reflector-refractor section.

8. A luminaire assembly as in claim 2, wherein said removable door includes radial laterally diffusing flutes disposed on its inner surface and horizontal circular refracting prisms disposed on its outer surface.

9. For use a luminaire assembly having a housing portion and a lamp, an optical unit adapted to be affixed to said housing portion in a sealed relationship to define an internal chamber to receive and enclose said lamp, said optical unit having an inner surface and an outer surface adapted for easy cleanability, comprising:

a bottom refractor having an opening defined therein, said bottom refractor having an inner surface with radial laterally diffusing flutes disposed thereon, and an outer surface with horizontal circular refracting prisms disposed thereon;

an upper reflector-refractor having an upper substantially vertical portion affixable to said housing portion and a lower portion affixable to said bottom refractor, said upper portion of said upper reflector-refractor having an inner surface with vertical laterally diffusing flutes disposed thereon, and an outer surface with horizontal vertically diffusing flutes disposed thereon, said lower portion of said upper reflector-refractor having an inner surface with horizontal prisms disposed thereon, and an outer surface with 90° reflecting prisms disposed thereon;

an internal metal reflector affixable to said upper portion of said upper reflector-refractor; and a removable door adapted to be affixed in a sealed relationship with said bottom refractor opening when in a closed position, said door further having a breathing aperture of a predetermined lateral dimension for permitting ambient air to enter and leave said internal chamber, said door having an inner surface with radial laterally diffusing flutes disposed thereon, and an outer surface with horizontal circular refracting prisms disposed thereon and having the characteristics of shedding water and accumulated contaminants therefrom without leaving a residue thereon, so as to promote said easy cleanability.

* * * * *